United States Patent [19]

Cole

[11] Patent Number: 4,683,596

[45] Date of Patent: Aug. 4, 1987

[54] CURL KEEPING HAIR CAP

[76] Inventor: Sheila N. Cole, 16551 Plymouth Rd., Detroit, Mich. 48227

[21] Appl. No.: 800,400

[22] Filed: Nov. 21, 1985

[51] Int. Cl.[4] ..... A42C 5/04

[52] U.S. Cl. ..... 2/174; 2/198

[58] Field of Search ..... 2/68, 174, 198, 207

[56] References Cited

U.S. PATENT DOCUMENTS

| | | | |
|---|---|---|---|
| 2,477,437 | 7/1949 | Borowick | 2/174 |
| 3,088,469 | 5/1963 | Berryhill et al. | 2/174 |
| 3,237,209 | 3/1966 | Gettinger | 2/174 |
| 3,370,304 | 2/1968 | Pelletier | 2/174 |
| 3,505,678 | 4/1970 | Key | 2/174 |
| 3,962,728 | 6/1976 | Paulinik | 2/174 |
| 4,457,027 | 7/1984 | Gladstone | 2/174 |

*Primary Examiner*—Henry S. Jaudon
*Attorney, Agent, or Firm*—Brooks & Kushman

[57] ABSTRACT

This invention pertains to a curl keeping hair cap made of a substantially circular sheet of nonabsorbent air permeable material for permitting air circulation with a casing secured along the circular edge of the sheet and a drawstring having an elastic portion extending through the casing to permit adjustment of the hair cap to fit the contour of the face and neck of the wearer by gathering along the casing. The drawstring has tie ends which can be tied to each other to maintain the elastic portion of the drawstring in a stretched condition. The hair cap may be made of a single piece of nylon. A method of maintaining a hair permanent comprises applying permanent curl solution to hair, rinsing the solution from the hair, and enclosing the hair in a substantially circular curl keeping hair cap of nonabsorbent air permeable material with a drawstring having an elastic portion to gather the cap and fit the contour of the face and neck.

2 Claims, 4 Drawing Figures

CURL KEEPING HAIR CAP

TECHNICAL FIELD

This invention relates generally to a curl keeping hair cap and in particular to a hair cap for maintaining a hair permanent.

BACKGROUND ART

Recently, hair permanents for men and women have become very popular, and time and money is spent attempting to maintain the hair permanent while at home. Curl relaxation has proven to be the most difficult type of hair permanent to maintain after leaving the hair salon.

Currently, the predominant method for attempting to maintain a curl relaxed hair style has been to enclose the hair with a non-porous plastic cap having an elasticized edge. A problem arises because the curl relaxed hair cannot breath and consequently prolonged wearing of the plastic cap causes bacteria to grow on the scalp. On the other hand, if the curl relaxed hair is not covered with some sort of cap for at least 15 to 20 minutes every day, the hair looses the curl and eventually returns to its original state.

Curl relaxed hair styles are also subject to disfiguration at night. Traditional methods which have been employed in the evening to maintain a curl relaxed hair style include wrapping the hair with paper, hair bonnets, and other head coverings which usually result in uncomfortable sleeping conditions and only partial maintenance of the curl relaxed hair style.

U.S. Pat. No. 2,522,251 discloses a cold wave permanent cap. In a cap for use in applying a cold wave permanent, a pair of substantially circular concave elements are joined together and fastened with a hook and tab arrangement. A portion of the hat extends below the hook and tab arrangement and trails down the neck onto the back of the wearer.

U.S. Pat. No. 3,556,115 discloses a coiffure protector formed substantially in the shape of a cubicle blank having a back wall, a pair of sidewalls and a front wall. The object of the invention is to provide a stiffening material in the sides of the coiffure protector to maintain the shape thereof and to prevent crushing the bouffant of the coiffure by the cap.

DISCLOSURE OF INVENTION

An object of the present invention is to provide an improved hair permanent maintaining hair cap. In carrying out this object, one use for which the invention has particular utility is in the maintaining of a hair style after a curl relaxation. A curl relaxed hair style is maintained as the cap has a design and is made of a nonabsorbent fabric to allow air to permeate the cap while retaining moisture in the hair.

The present invention is a curl keeping hair cap made of a substantially circular sheet of nonabsorbent air permeable material for permitting air circulation having a casing secured along the circular edge of the sheet and a drawstring extending through the casing. The drawstring has an elastic portion within the length of the drawstring to permit adjustment of the hair cap to fit the contour of the face and neck of the wearer by gathering along the casing. The drawstring has tie ends which can be tied to each other to maintain the elastic portion in a stretched condition. The air permeable material may comprise nylon. The sheet of nonabsorbent air permeable material is made of a single piece, having a mesh size of 45 mesh. The elastic portion of the drawstring is approximately one fourth of the entire length of the drawstring, and is positioned in the middle. The casing may be made of cotton for the comfort of the wearer.

Another object of the present invention is to provide a method for maintaining a hair permanent or a curl relaxed hair style. The method comprises applying permanent curl or curl relaxing solution to the hair, rinsing all of the permanent curl or curl relaxing solution from the hair and enclosing the hair in a substantially circular curl keeping hair cap of nonabsorbent air permeable material with a drawstring having an elastic portion which will gather the cap to fit the contour of the face and neck of the wearer. This method will maintain a hair permanent or a curl relaxed hair style during work, play, or sleep.

DESCRIPTION OF THE INVENTION

Figure 1:
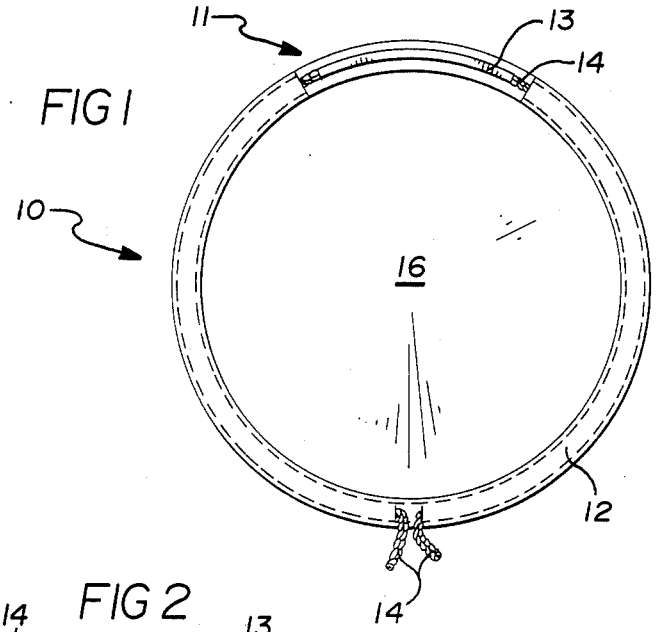
FIG. 1 is a top plan view of a hair cap with an ungathered tensioning band.

Referring now to the drawings, a hair cap constructed in accordance with the present invention is generally indicated by 10. The hair cap 10 is shown in an ungathered state, and is formed of a substantially circular, singular sheet 16 of nonabsorbent air permeable material such as nylon or the like. A casing 12 is secured along the circular edges of sheet 16 and contains a drawstring tensioning band 11 having an elastic portion 13 and tie end portions 14. Tie end portions 14 extend from the casing 12 so that they may be pulled to adjust and gather the cap about the face and neck of the wearer. For the sake of comfort, casing 12 is preferably constructed of cotton or the like, while the nonabsorbent air permeable material is preferably comprised of nylon having a mesh size of 45 mesh or a fabric composed of 45 weft yarns and 45 warp yarns per inch.

Figure 2:
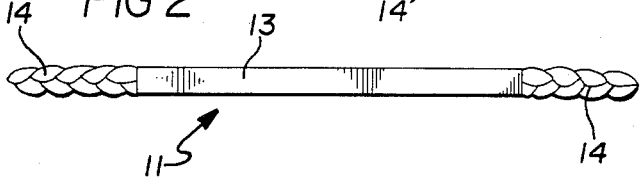
FIG. 2 is a view of the tensioning band before insertion within the hair cap.

In combined reference to FIG. 1 and FIG. 2, drawstring tensioning band 11 is shown having an elastic portion 13, and tie end portions 14. The abutting edges of the tie ends 14 and the elastic section 13 are secured together, such as by sewing.

Distinct advantages are achieved by the drawstring tensioning band 11 having an elastic portion 13 and tie end portions 14. The drawstring tensioning band 11 includes both the elastic and tie end portions to maximize adjustment of the hair cap around the face and neck. In the preferred embodiment of the invention, the tie end portions of the drawstring tensioning band 11 are approximately three times as long as the elastic portion. Without the elastic portion 13, drawstring tensioning band 11 would not have the same adjustment capabilities. The elastic portion 13 is positioned in the middle of equal lengths of the tie end 14 for maximum results.

Figure 3:
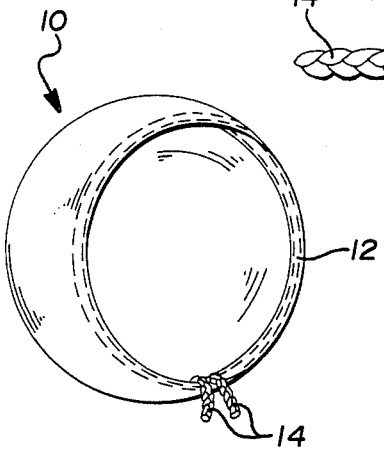
FIG. 3 is a perspective view of the hair cap.

Referring now to FIG. 3, a completely assembled hair cap is illustrated, detailing the location of the casing 12 and the tie ends 14. The tie ends 14 extend from the bottom of the hair cap and are tied together to adjust the hair cap around the head of the wearer.

Figure 4:
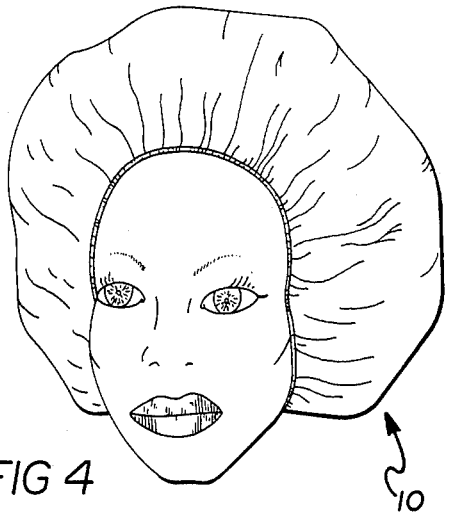
FIG. 4 is a perspective view of the hair cap on the head of a wearer.

Referring now to FIG. 4, hair cap 10 is shown worn on the head of a woman. As can be seen from the illustration, hair cap 10 covers all of the woman's hair, and may be worn in other ways for work or play in a more fashionable manner to protect and maintain the hairdo. The advantage of making the cap of nylon is that hair which has had hair permanent or curl relaxation solutions applied to it may receive air through the hair cap, while not allowing moisture to be released to the atmosphere. This prevents the growth of bacteria on the scalp of the wearer and promotes better health.

The cap is preferably fashioned of a nonabsorbent fabric so the moisture on the hair is not withdrawn by the cap. It is of great importance that as much moisture as possible is retained in the hair of the wearer. More importantly, though, the cap allows the hair to breath, without losing moisture and the permanent is maintained.

A method of maintaining a hair permanent includes the application of permanent curl solution to the hair, rinsing the solution from the hair, and enclosing the hair in a substantially circular curl keeping hair cap of nonabsorbent air permeable material with a drawstring having an elastic portion to gather the cap and fit the contour of the face and neck. After the permanent or curl relaxer solution has been placed on the hair and the hair has been set, the hair cap is adjusted around the hair and tensioned about the face of the wearer. A hair cap used in accordance with the invention maintains the desired state of hair style because a sufficient amount of air is circulated through the cap, while retaining moisture within the hair strands themselves.

While the preferred embodiments have been described in detail, those familiar with the art to which this invention relates will recognize various alternative ways of practicing the invention as defined by the following claims.

What is claimed is:

1. A curl keeping hair cap comprising:

a. a substantially circular sheet of a single piece of nonabsorbent air permeable nylon material having a 45 mesh which permits air circulation;

b. a casing of cotton material secured along the circular edge of the sheet of air permeable material; and c. a drawstring extending through the casing and having an elastic portion positioned in the middle thereof to permit adjustment of the hair cap to fit the contour of the face and neck of the wearer by gathering along the casing, and said drawstring having tie ends which can be tied to each other to maintain the elastic portion in a stretched condition.

2. A hair cap as in claim 1, wherein the elastic portion of said drawstring is approximately one fourth the length of the drawstring.

* * * * *